United States Patent [19]

Haas

[11] Patent Number: 5,035,765

[45] Date of Patent: Jul. 30, 1991

[54] INSTALLATION FOR ETCHING OBJECTS

[75] Inventor: Rainer Haas, Herrenberg, Fed. Rep. of Germany

[73] Assignee: Hans Hollmuller Maschinenbau GmbH & Co, Fed. Rep. of Germany

[21] Appl. No.: 543,826

[22] PCT Filed: Nov. 10, 1989

[86] PCT No.: PCT/EP89/01345

§ 371 Date: Jul. 20, 1990

§ 102(e) Date: Jul. 20, 1990

[87] PCT Pub. No.: WO90/05797

PCT Pub. Date: May 31, 1990

[30] Foreign Application Priority Data

Nov. 24, 1988 [DE] Fed. Rep. of Germany ..... 3839651

[51] Int. Cl.[5] ..... B44C 1/22; C23F 1/00

[52] U.S. Cl. ..... 156/345; 156/627; 156/642

[58] Field of Search ..... 156/627, 640, 642, 656, 156/666, 345, 901, 902; 134/103, 105, 198, 199; 204/235, 236, 237, 238, 239, 240, 241

[56] References Cited

U.S. PATENT DOCUMENTS 4,190,481 2/1980 Goffredo ..... 156/627 X
4,576,677 3/1986 Faul et al. ..... 156/642
4,741,798 5/1988 Haas ..... 156/626
4,772,365 9/1988 Haas ..... 204/106

FOREIGN PATENT DOCUMENTS 0117068 8/1984 European Pat. Off. .
0144742 6/1985 European Pat. Off. .
0146798 7/1985 European Pat. Off. .
0158910 10/1985 European Pat. Off. .
WO86/00094 1/1986 European Pat. Off. .

*Primary Examiner*—William A. Powell
*Attorney, Agent, or Firm*—Fred Philpitt

[57] ABSTRACT

An installation for etching objects comprises at least one etching machine, in which metal is etched from the treated objects, the etching medium being enriched with metal. The etching medium is regenerated again in several electrolytic cells by the removal of metal. The electrolytic cells are brought into operation successively in adaptation to different instantaneous etching capacities of the etching machine ("loads"). This takes place by means of a device, which integrates the quantity of the enriched etching medium removed from the etching machine, over a predetermined period of time. A certain limit value of this integral is associated with each electrolytic cell; if this limit value is exceeded, the corresponding electrolytic cell is activated. In this way, the total capacity of the respective electrolytic cells in operation is adapted to the instantaneous load of the etching machine.

10 Claims, 1 Drawing Sheet

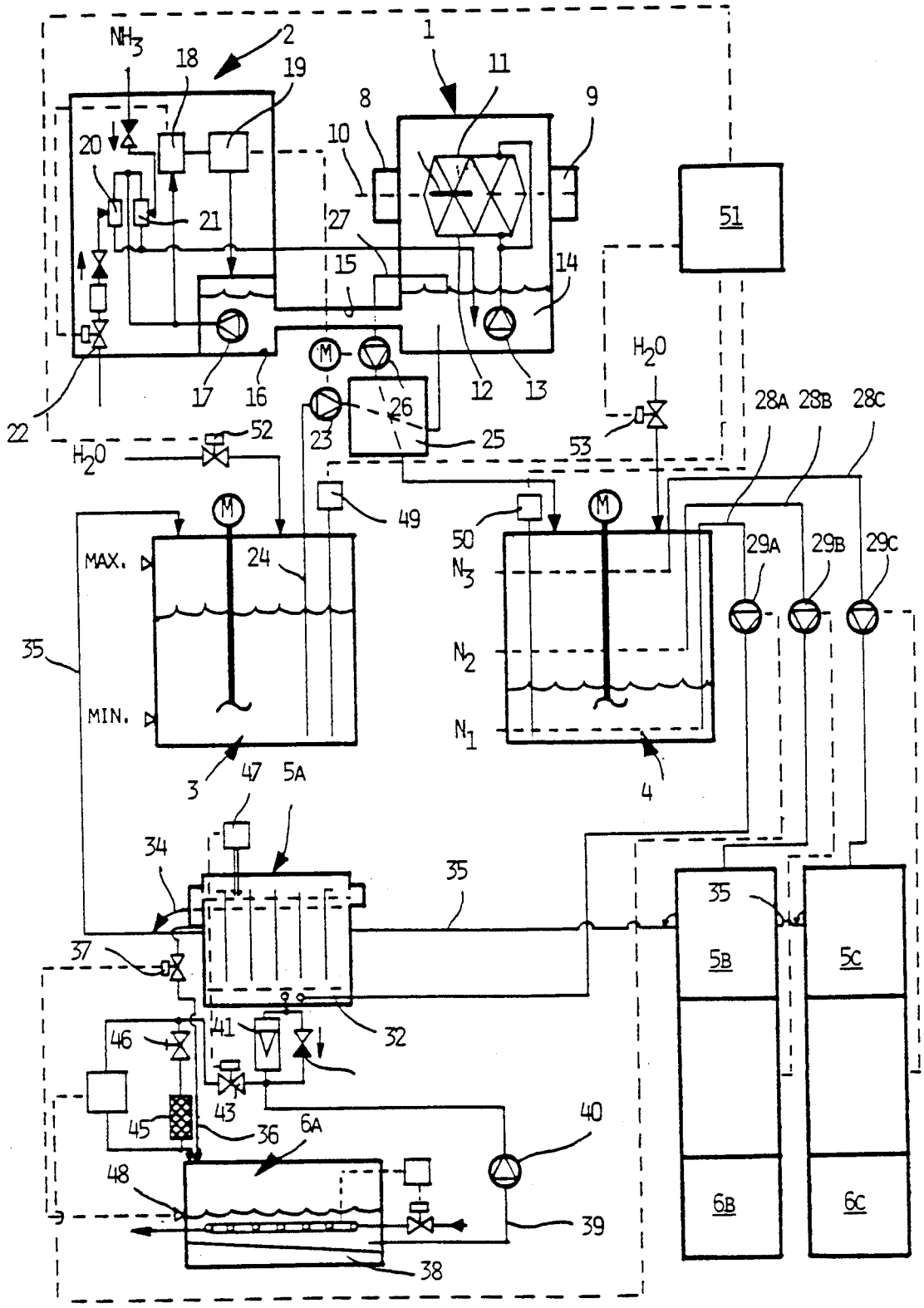
NH3
2
1
18
19
11
8
9
10
20
21
27
15
14
51
17
16
12
13
22
26
23
25
52
53
H2O
28A
28B
28C
49
50
MAX.
24
29A
29B
29C
N3
N2
N1
35
MIN.
3
47
5A
4
34
37
41
32
46
43
45
36
6A
40
48
39
38
5B
5C
6B
6C

INSTALLATION FOR ETCHING OBJECTS

The invention relates to an installation for etching objects, in particular printed circuit boards, with a) at least one etching machine, in which metal is etched from the objects, the etching medium being enriched with metal;

b) at least one electrolytic cell, in which enriched etching medium is depleted;

c) at least one electronic control circuit, which controls the exchange of etching medium between the etching machine and the electrolytic cell so that the density of the etching medium in the etching machine is substantially constant.

In known installations of this type, the capacity of the electrolytic cells is adapted to the maximum capacity of the etching machine, the control system always setting the electrolytic cell in operation when the density of the etching medium in the etching machine exceeds a certain value. These etching installations sometimes also contain several electrolytic cells connected in parallel, however this is for manufacturing reasons, since then a uniform type of electrolytic cell can be used for etching machines of the most varied capacity. All the electrolytic cells are always operated as a unit. In these known etching installations, the following is a drawback: if etching machines, which have a larger capacity, are operated with a low instantaneous etching capacity ("load"), the connected electrolytic cells very frequently switch on and off. However, such non-continuous operation of the electrolytic cells leads to a poor formation of the metal layer on the cathodes. In addition, the control of the density of the etching medium to the desired value for each new switching-on of the electrolytic cells only begins late, since the latter are normally put out of operation by discharge of the etching medium and a considerable time lapses until re-filling of the etching medium. The considerable control fluctuations of the density of the etching medium in the etching machine connected therewith have a disadvantageous effect on the etching result.

It is the object of the present invention to design an etching installation of the aforementioned type so that the switching-on of the electrolytic cells takes place with better adaptation to the instantaneous load of the etching machine and the frequency of switching-on and off of the electrolytic cells is reduced.

The solution of this object according to the invention is characterised by c) a device, which ea) measures the quantity of the enriched etching medium removed from the etching machine and integrates it over a predetermined time;

eb) in which as many limit values of different quantity for the integral are stored, as there are electrolytic cells in the installation;

ec) on exceeding each limit value of the integral a (further) electrolytic cell is set in operation or on falling below each limit value of the integral a (further) electrolytic cell is put out of operation;

so that the more electrolytic cells are in operation, the more enriched etching medium is removed from the etching machine in the predetermined time.

Thus, according to the invention, several electrolytic cells of lower capacity are used intentionally, not solely for manufacturing reasons, as was the case in the prior art. These electrolytic cells are not all connected as a unit; on the contrary, the number of electrolytic cells which are in operation at any time, is determined by the quantity of etching medium removed from the etching machine over a predetermined integration time. With a very small quantity of etching medium, thus solely a single electrolytic cell is in operation, which is then connected to a further electrolytic cell, when the amount of etching medium exceeds the first limit value of the integral and so on. This has the result that the frequency of switching the electrolytic cells on and off is considerably reduced. The build-up of the metal layer on the cathodes is considerably better than in the prior art. Considerably lower control fluctuations in the density control of the etching medium in the etching machine also result, which in turn leads to better etching results.

In a particularly preferred embodiment, the device which takes over the control of the electrolytic cells, has a mechanical construction. In this case, it comprises a buffer tank, into which the enriched etching medium removed from the etching machine is introduced, the buffer tank in each case being connected by way of a line, in which a pump is located, to each electrolytic cell and a different level of the filling height in the buffer tank being associated with each of these pumps so that it is operative solely after exceeding this level. This mechanical realisation of the idea according to the invention is based on the following consideration: all pumps, which convey etching medium from the buffer tank to the various electrolytic cells, have a certain, limited discharge capacity co-ordinated with the capacity of the electrolytic cell. As long as the discharge capacity of the first pump, which connects the buffer tank to the first electrolytic cell, is adequate, the level of the filling height in the buffer tank never rises above a certain value. However, if the output of etching medium from the etching machine is greater than the first pump can remove, the level of the filling height in the buffer tank rises until the second pump becomes operative on reaching the next limit value. Now both pumps work together with the sum of their delivery capacities. A further rise of the etching medium in the buffer tank takes place solely if the quantity of etching medium supplied per unit time by the etching machine exceeds the combined delivery capacity of the first two pumps; then, a third pump possibly starts up, which conveys etching medium to the third electrolytic cell and so on.

With this embodiment, two methods of construction are again possible: in the first, level sensors are provided, which monitor when various limit values of the filling height in the buffer tank are reached and start or stop the corresponding pumps in accordance therewith.

It is simpler, if the lines, by which the etching medium is removed from the buffer tank, terminate at the height of the various levels of the filling heights and if the pumps operate continuously. In this case, the pumps, which are not necessary for discharging the etching medium supplied per unit time to the buffer tank, are simply therefore out of operation (and likewise the connected electrolytic cells), because the associated removal line does not reach into the etching medium in the buffer tank.

It is particularly appropriate if a buffer tank is likewise located in the line, by which the depleted etching medium is conveyed back from the electrolytic cells to the etching machine. Together with the buffer tank already mentioned above, which serves as a "sensor" for the quantity of etching medium removed per unit time from the etching machine, this further buffer tank decouples the control systems, which on the one hand in the etching machine and on the other hand in the electrolytic cells ensure a constant density of the etching medium located there.

For saving energy, it may be provided that the etching medium supplied to one buffer tank from the etching machine and the etching medium supplied from the other buffer tank to the etching machine are passed through a heat exchanger.

If one uses buffer tanks, as proposed above, then the evaporation of liquid is increased, which can also be ascertained in other installations, even if in smaller quantities. To supplement the loss of liquid, it is recommended that a water control unit is provided, which keeps the sum of the filling heights in the various sumps, containers and tanks of the etching installation constant by the addition of fresh water.

As regards circuit techniques and apparatus, that embodiment is particularly favourable, in which a) the filling heights in the buffer tanks are monitored by level sensors, which are connected to the water control unit;
b) the sum of the filling heights in the buffer tanks is kept constant by the addition of fresh water;
c) the filling heights in the other parts of the installation are kept constant independent of the addition of fresh water.

Generally the above condition c) is fulfilled anyway by the method of construction of the etching machine and the electrolytic cells. Thus, in this case, solely the filling heights in the two buffer tanks need to be monitored, to which the corresponding quantity of fresh water is then supplied.

Now in order to avoid that the supply of fresh water to the buffer tanks leads to undesirable dilutions of the etching medium contained therein, the addition of fresh water to each of the buffer tanks advantageously takes place in relation to the filling heights of these buffer tanks. The buffer tank which is more full thus contains a greater quantity of fresh water than the buffer tank which is more empty, so that the dilution by fresh water in both buffer tanks is approximately the same.

Whereas, in the embodiments of the invention described above in detail, the device which undertakes the control of the electrolytic cells, was constructed mechanically, it is also possible that this device is constructed electrically and comprises:

ed) a flow meter;
ef) an integrator, which integrates the output signal of the flow meter over the predetermined period of time;
eg) a memory, in which the various limit values of the integral are stored;
eh) a comparator, which compares the output signal of the integrator with the limit value stored in the memory and on reaching one of these limit values brings the associated electrolytic cell into or out of operation.

One embodiment of the invention will be described hereafter in detail with reference to the drawings; the single FIGURE shows diagrammatically an installation for etching objects.

The installation for etching objects illustrated in the drawing comprises as its main components an etching machine 1, a dosing unit 2, a first buffer tank 3, a second buffer tank 4, three electrolytic cells 5*a*, 5*b*, 5*c* as well as three storage tanks 6*a*, 6*b*, 6*c* for etching medium discharged from the electrolytic cells 5*a*, 5*b*, 5*c*. The electrolytic cells 5*b*, 5*c*, the associated storage tanks 6*b*, 6*c* and the connecting lines and other devices are indicated solely diagrammatically by boxes; they correspond to the electrolytic cell 5*a* and the associated storage tank 6*a* as well as to the corresponding connecting lines and other devices shown in detail.

The construction of the etching machine 1 is basically known: the objects 7 to be etched are moved by the continuous method from an inlet 8 to an outlet 9 of the etching machine on a roller conveying system 10. They thus pass an upper nozzle arrangement 11 as well as a lower nozzle arrangement 12, by which they are sprayed with etching medium. The latter is supplied by a pump 13, which is connected on the suction side to the sump 14 of the etching machine, to the nozzle arrangements 11, 12. The etching medium drips from the objects 7 to be etched back into the sump, in which case it changes its chemical composition on account of the etching process and due to evaporation processes.

A dosing unit 2 is provided for monitoring and controlling the chemical composition of the etching medium in the etching machine 1. The sump 14 of the etching machine 1 is connected by way of a connecting line 15 to a tank 16 of the dosing unit 2. A pump 17 removes etching medium continuously from the tank 16 and returns the latter in the circuit by way of a ph-meter 18 and a density-measuring device 19 to the tank 16. The pressure side of the pump 17 is furthermore connected to two injectors 20, 21, in which $NH_3$ is mixed with the flowing etching medium.

In the left-hand injector 20 in the drawing, $NH_3$ is added to the flowing etching medium, which $NH_3$ originates from a storage tank and the flow of which is determined by a solenoid valve 22. The solenoid valve 22 is in this case controlled electrically by the ph-meter 18. A minimum pH value of the etching medium in the etching machine 1 is thus ensured by means of the ph-meter 18 due to the addition of $NH_3$ by way of the solenoid valve 22.

By way of the right-hand injector 21 in the drawing, the gas sucked from the electrolytic cells 5*a*, 5*b*, 5*c*, which contains substantially ammonia, is returned to the etching medium. In this way, the evaporation losses of $NH_3$ are kept small and environmental problems are reduced.

By means of the above-mentioned density-measuring device 19, the density of the etching medium in the etching machine 1, which without special precautions was increased by the metal etched from the objects 7 (in the case of printed circuit boards generally copper), is kept at a constant value. This takes place in the following manner:

The left-hand buffer tank 3 in the drawing contains a supply of etching medium, which was supplied by the electrolytic cells 5*a*, 5*b*, 5*c* in a manner described hereafter. On the other hand, the right-hand buffer tank 4 in the drawing contains etching medium of higher density, enriched with copper, which will be supplied for depletion to the electrolytic cells 5*a*, 5*b*, 5*c* in a manner likewise to be described hereafter.

A pump 23 is connected on the suction side by way of a line 24 to the buffer tank 3. It conveys the depleted etching medium removed from the buffer tank 3 through a heat exchanger 25 into the sump 14 of the etching machine 1. A further pump 26 is connected by way of a line 27 on the suction side to the sump 14 of the etching machine 1. The opening point of the line 27 is located at a height which corresponds to the operating level of the sump 14 in the etching machine 1. The pump 26 likewise conveys the etching medium removed from the sump 14 of the etching machine 1 through the heat exchanger 25, where a heat exchange takes place between the etching medium supplied to the sump and the etching medium removed from the sump 14. The etching medium conveyed by the pump 26 then flows from the heat exchanger 25 into the second buffer tank 4, in which, as mentioned above, etching medium enriched with copper is located.

The pumps 23 and 26 are connected to each other electrically or—as illustrated—mechanically by a common motor. The arrangement is such that both pumps 23, 26 are always operated simultaneously, the delivery capacity of the pump 26 always being kept somewhat higher than the delivery capacity of the pump 23. In this way it is ensured that the operating level of the etching medium in the sump 14 of the etching machine 1 is always determined by the opening point of the line 27 into the sump 14.

The right-hand buffer tank 4 in the drawing is connected by lines 28*a*, 28*b*, 28*c* to the suction side of pumps 29*a*, 29*b*, 29*c*, which are connected on the pressure side to the sumps 32 of the electrolytic cells 5*a*, 5*b*, 5*c*.

The overflows 34 of the electrolytic cells 5*a*, 5*b*, 5*c*, from which the depleted etching medium flows, are connected by way of a line 35 to the left-hand first buffer tank 3 in the drawing. A further line 36, in which a solenoid valve 37 is connected, leads from the overflow 34 of each electrolytic cell 5*a*, 5*b*, 5*c* into the associated storage tank 6*a*, 6*b*, 6*c*. The sump 38 of each storage tank 6*a*, 6*b*, 6*c* is connected by way of a line 39 to a pump 40, which supplies the etching medium removed from the sump 38 by way of a flow meter 41, with which a non-return valve 42 is connected in parallel, to the sump 32 of the electrolytic cell 5*a*, 5*b*, 5*c*. The pump 40 is also connected on the pressure side to a solenoid valve 43, which controls the flow path to a density-measuring device 44. The etching medium flowing through the density-measuring device 44 is returned to the storage tanks 6*a*, 6*b*, 6*c*.

Located in parallel with the density-measuring device 44 is a hydroxide filter 45, the flow through which can be initiated if required by means of a valve 46.

Electrolytic cells 5*a*, 5*b*, 5*c* and storage tanks 6*a*, 6*b*, 6*c* are operated and controlled in the following manner:

First of all it is assumed that the delivery capacity of the pump 29*a* associated with the first electrolytic cell 5*a* is adequate for discharging the quantity of etching medium integrated over a predetermined period of time, which etching medium flows into the buffer tank 4. Then the filling height in the buffer tank 4 remains at the height which corresponds to the opening point of the line 28*a* into the buffer tank. The other pumps 29*b*, 29*c* and the electrolytic cells 5*b*, 5*c* associated therewith are not in operation and first of all may be disregarded.

At the beginning of operation, the electrolytic cell 5*a* must be filled with etching medium from the storage tank 6*a*. This takes place by means of the pump 40. When the electrolytic cell 5*a* has reached its filling level, this is ascertained by a level sensor 47, which opens the solenoid valve 43. This releases a flow bypass, which reduces the flow of etching medium from the storage tank 6*a* into the electrolytic cell 5*a* to the amount necessary during continuous operation. A major part of the etching medium conveyed by the pump 40 now flows through the density-measuring device 44 and through the hydroxide filter 45 back to the storage tank 6*a*.

Normally the solenoid valve 37 is open. This means the etching medium is continuously circulated by the pump 40 by way of the electrolytic cell 5*a*, its overflow 34 and the solenoid valve 37. However, if etching medium passes from the buffer tank 4 into the sump 32 of the electrolytic cell 5*a*, the level in the sump 38 of the storage tank 6*a* rises. A level switch 48 records the rise of the liquid level in the sump 38 and closes the solenoid valve 37. Depleted etching medium now flows by way of the line 35 into the buffer tank 3.

The density-measuring device 44 monitors the copper content of the etching medium circulated by the pump 40. If this copper content drops below a predetermined value, for example below 30 g/l, then the pump 29 is set in operation. On account of the above-described operations, in this case a corresponding quantity of etching medium is removed from the electrolytic cell 5*a* and supplied to the buffer tank 3. The supply of enriched etching medium from the buffer tank 4 increases the density of the etching medium in the electrolytic cell 5*a* until the density-measuring device 44 once more stops the pump 29.

The electrolytic cell 5*a* is put out of operation if the buffer tank 4 is empty. This takes place by switching-off the pump 40. Consequently the contents of the electrolytic cell 5*a* flow back by way of the density-measuring device 41 and mainly by way of the non-return valve 42, line 39 and pump 40 into the storage tank 6*a*. However, the electrolytic cell 5*a* remains alive.

For safety reasons, the electrolytic cell 5*a* is moreover always shut down when the density of the etching medium contained therein falls below a second value, which is below the above-mentioned control point.

The entire, above-described installation clearly contains two control systems, which are isolated from each other by the two buffer tanks 3, 4:

The density-measuring device 19 operating in the first control circuit ensures a constant density of the etching medium in the etching machine 1. The constant density is brought about by the supply of depleted etching medium from the buffer tank 3 or by the discharge of enriched etching medium into the buffer tank 4. Owing to the existence of the buffer tanks 3, 4, independently of the respective function of the electrolytic cell 5*a*, depleted etching medium or space for enriched etching medium is always available. The first control system, which contains the density-measuring device 19 as the "core", can thus operate completely "autonomously".

The second control system contains the density-measuring device 44 as the controlling unit. It ensures that the density and thus the copper content of the etching medium in the electrolytic cell 5*a* is kept at a predetermined value. This takes place, as described above, by starting or stopping the pump 29*a*. Once more this control system is completely isolated from the first control system, which contains the etching machine 1, since the electrolytic cell 5*a* can deliver depleted etching medium to the buffer tank 3 independently of the instantaneous requirement. Likewise, enriched etching medium can always be supplied from the buffer tank 4 to the electrolytic cell 5*a* according to the requirements of the control circuit governing this, irrespective of whether etching medium just enriched there is or is not present according to the state in the etching machine 1.

Due to the afore-described isolation of the two control systems, it is possible to regulate and keep constant the density of the etching medium at the actually critical point, namely in the etching machine 1, with greater precision than this could be achieved when using solely one control system, which covers both the etching machine 1 as well as the electrolytic cell 5*a*. However, the two buffer tanks 3 and 4 can be used in a further advantageous manner, details of which will now be given:

The previous description was given on the assumption (as already mentioned above), that the quantity of enriched etching medium removed from the sump 14 of the etching machine 1 by the pump 26 over a predetermined time is relatively small. The pump 29*a*, which supplies the etching medium from the buffer tank 4 to the first electrolytic cell 5*a*, is in this case capable of once more pumping out all the etching medium introduced into the buffer tank 4 from the etching machine 1. The level of the filling height in the buffer tank 4 remains below the height of the opening of the line 28*a* in the buffer tank 4, thus below the height designated by the reference $N_1$ in the drawing. However, if a greater quantity of etching medium occurs, integrated over the predetermined time, then finally the delivery capacity of the pump 29*a* alone is no longer sufficient for discharging this etching medium from the buffer tank 4. The filling height in the buffer tank 4 rises until the liquid level reaches the height $N_2$. This is the height at which the line 28*b* opens into the buffer tank 4. Now the pump 29*b* also becomes operative, which supplies etching medium to the electrolytic cell 5*b*. The electrolytic cell 5*b* co-operates with the associated control circuit and the storage tank 6*b* in the same way as was described above in detail for the first electrolytic cell 5*a* and the corresponding storage tank 6*a*. The etching medium depleted by the electrolytic cell 5*b* passes by way of the overflow 34*b* into the line 35 and from there into the buffer tank 3.

If even the combined delivery capacity of the pumps 29*a*, 29*b* is no longer sufficient for discharging the etching medium supplied to the buffer tank 4 in the predetermined period of time, the filling height in the buffer tank 4 rises above the value $N_2$, until finally the value N is reached. Located at this height is the opening point of the line 28*c*, which leads to the pump 29*c* and from there to the third electrolytic cell 5*c*. Now, in this way, the third electrolytic cell 5*c* also comes into operation in the same way, as was described above the electrolytic cells 5*a* and 5*b*. Naturally, if required, further pumps 29 and electrolytic cells 5 may be added.

In the embodiment illustrated in the drawing, the pumps 29*a*, 29*b*, 29*c* and thus the electrolytic cells 5*a*, 5*b*, 5*c* were operative at different levels of the filling height in the buffer tank 4 due to the fact that the opening points of the associated lines 28*a*, 28*b*, 28*c* lay at different heights. Naturally it is also possible to locate all these removal lines 28*a*, 28*b*, 28*c* close to the bottom of the buffer tank 4 and to control the switching-on of the various pumps 29*a*, 29*b*, 29*c* by suitable electrical level sensors.

The embodiment of the invention illustrated in the drawing represents a mechanical realisation of a principle, which can also be implemented electronically. The buffer tank 5 is basically nothing other than an integrator, which integrates the quantity of etching medium supplied thereto over a predetermined period of time. The levels $N_1$, $N_2$, $N_3$ represent limit values of this integral. It is therefore also possible to replace the buffer tank 4 by an electrical device, in which the same logical functions are carried out. In detail this takes place as follows:

A flow meter is located in the line 27, by which enriched etching medium is removed from the sump 14 of the etching machine 1. The output signal of the flow meter is supplied to an electrical integrator, which integrates this output signal in each case over a predetermined period of time. When the output signal of this integrator reaches one of several limit values stored in a memory, then the path to a (further) electrolytic cell 5*a*, 5*b*, 5*c* respectively is released or blocked. For this purpose, a comparator is used, which compares the value of the output signal of the integrator with the limit values stored in the memory. The comparator may then bring the pumps 29*a*, 29*b*, 29*c* for example into or out of operation in succession. The point at which the lines 28*a*, 28*b*, 28*c* combine and acquire a connection to the line 27, does not need to be located in a buffer tank 4. Of course this is possible, if the above-described isolating effect of the buffer tanks 3, 4 between the control systems of the etching machine 1 and electrolytic cells 5*a*, 5*b*, 5*c* is to be utilised.

In known etching installations, the operating times of the etching machine 1 and of the electrolytic cells 5*a*, 5*b*, 5*c* used for the regeneration of the etching medium are identical daily. If, as described above, buffer tanks 3 and 4 are used, the operating times may be kept different. In this way, a smaller capacity of the electrolytic cells 5*a*, 5*b*, 5*c* is adequate; it no longer needs to be adapted to the peak requirement of the etching machine 1.

An example

The etching machine 1 is designed so that it etches away 9 kg Cu per hour, i.e. 72 kg in an 8-hour working day. In order to recover the same quantity of copper in the electrolytic cells 5*a*, 5*b*, 5*c*, provided that they work for 24 hours a day, a capacity of 3 kg Cu/hour is sufficient for this. If the depletion in the electrolytic cells amounts to 50 g Cu/l, this means that 1440 l etching medium must be buffered. However, since approximately 480 l are recovered from the electrolytic cells 5*a*, 5*b*, 5*c* in the 8 hours of the operating time of the etching machine 1, each buffer tank 3, 4 must contain approximately 1000 l.

The continuous method of operation of the electrolytic cells 5*a*, 5*b*, 5*c* possible when using the buffer tanks 3, 4, not only reduces the expenditure for apparatus of the entire etching installation; in addition it improves the regeneration operation in the electrolytic cells 5*a*, 5*b*, 5*c*.

During the operation of each etching installation, but particularly when using buffer tanks 3, 4, liquid losses occur due to evaporation. These liquid losses must be compensated for. In the above-described etching installation, this takes place as follows:

The levels in the buffer tanks 3, 4 are monitored continuously by level sensors 49 or 50. The latter are connected to an electronic water-control unit 51. By way of electrical leads, which are shown in broken line in the drawing, the electronic water-control unit 51 again controls a first solenoid valve 52, which controls the fresh water supply into the left-hand buffer tank 3 in the drawing, as well as a second solenoid valve 53, which controls the fresh water supply to the right-hand buffer tank 4 in the drawing.

Due to the above-described method of operation of the etching machine 1 and of the electrolytic cells 5*a*, 5*b*, 5*c*, it is ensured that a constant filling level is guaranteed therein without special measures. It is therefore solely still necessary to ensure that the sum of the levels in the two buffer tanks 3, 4 likewise remains constant. This is exactly the purpose of the water-control unit 51. If the latter ascertains a drop of levels in the buffer tanks 3, 4 in such a way that the sum thereof falls below a reference value, it opens the solenoid valves 52, 53 until the sum of the levels has once more reached the desired value. In order to obviate undesirable dilutions of the etching medium, which could disturb the operation of the various control circuits, the addition of water to each of the buffer tanks 3, 4 takes place in proportion to the respective level in this tank. Thus, for example, if the level in the left-hand buffer tank 3 in the drawing is twice as high as in the right-hand buffer tank 4 in the drawing, then the addition of water by the water-control unit 51 takes place in such a way that twice as much water is supplied to the left-hand buffer tank 3 as to the right-hand buffer tank 4.

I claim:

1. Installation for etching objects, in particular printed circuit boards, with a) at least one etching machine, in which metal is etched from the objects, the etching medium being enriched with metal;

b) at least one electrolytic cell, in which enriched etching medium is depleted;

c) at least one electronic control circuit, which controls the exchange of etching medium between the etching machine and the electrolytic cell so that the density of the etching medium in the etching machine is substantially constant, characterised by d) at least one further electrolytic cell (5*b*, 5*c*), which is connected in parallel with the first electrolytic cell (5*a*);

e) a device (4, 28*a*, 28*b*, 28*c*, 29*a*, 29*b*, 29*c*), which ea) measures the quantity of the enriched etching medium removed from the etching machine (1) and integrates it over a certain period of time;

eb) in which as many limit values of varying amount of the integral are stored, as there are electrolytic cells (5*a*, 5*b*, 5*c*) in the installation;

ec) on exceeding each limit value of the integral a (further) electrolytic cell (5*a*, 5*b*, 5*c*) is set in operation or on falling below each limit value of the quantity integral a (further) electrolytic cell (5*a*, 5*b*, 5*c*) is put out of operation, so that the more electrolytic cells (5*a*, 5*b*, 5*c*) are operating, the more enriched etching medium is removed from the etching machine (1) in the predetermined time.

2. Etching installation according to claim 1, characterised in that the device named in e) comprises a buffer tank (4), into which the enriched etching medium removed from the etching machine (1) is introduced, the buffer tank (4) being connected respectively by way of a line (28*a*, 28*b*, 28*c*), in which a pump (29*a*, 29*b*, 29*c*) is located, to each electrolytic cell (5*a*, 5*b*, 5*c*) and another level ($N_1$, $N_2$, $N_3$) of the filling height in the buffer tank (4) is associated with each pump (29*a*, 29*b*, 29*c*) so that it is effective solely after exceeding this level($N_1$, $N_2$, $N_3$).

3. Etching installation according to claim 2, characterised in that level sensors are provided, which monitor the reaching of the various levels ($N_1$, $N_2$, $N_3$) of the filling height in the buffer tank (4) and in response to this set the corresponding pumps (29*a*, 29*b*, 29*c*) in or out of operation.

4. Etching installation according to claim 2, characterised in that the lines (28*a*, 28*b*, 28*c*), by which the etching medium is removed from the buffer tank (4), terminate at the height of the various levels ($N_1$, $N_2$, $N_3$) of the filling heights and that the pumps (29*a*, 29*b*, 29*c*) are constantly in operation.

5. Etching installation according to claim 2 characterised in that a buffer tank (3) is likewise located in the line (35), by which the depleted etching medium is conveyed backfrom the electrolytic cells (5*a*, 5*b*, 5*c*) to the etching machine (1).

6. Etching installation according to claim 5, characterised in that the etching medium supplied to one buffer tank (4) from the etching machine (1) and the etching medium supplied to the etching machine (1) from the other buffer tank (3) are guided by way of a heat exchanger (25).

7. Etching installation according to claim 5 characterised in that a water control unit (51) is provided, which keeps the sum of the filling heights in the various sumps (14, 32), containers (16, 38) and tanks (3, 4) of the etching installation constant by adding fresh water.

8. Etching installation according to claim 7, characterised in that a) the filling heights in the buffer tanks (3, 4) are monitored by level sensors (49, 50), which are connected to the water control unit (51);

b) the sum of the filling heights in the buffer tanks (3, 4) is kept constant by adding fresh water;

c) the filling heights in the other parts of the installation are kept constant independent of the addition of fresh water.

9. Etching installation according to claim 8, characterised in that the addition of fresh water to each of the buffer tanks (3, 4) takes place in proportion to the filling heights of these buffer tanks (3, 4).

10. Etching installation according to claim 1, characterised in that the device mentioned in e) is constructed electrically and comprises:

ed) a flow meter;

ef) an integrator, which integrates the output signal of the flow meter over the predetermined time;

eg) a memory, in which the various limit values of the integral are stored;

eh) a comparator, which compares the output signal of the integrator with the limit values stored in the memory and on reaching one of these limit values sets the associated electrolytic cell (5*a*, 5*b*, 5*c*) in or out of operation.

* * * * *